US005272281A

United States Patent [19]

Bouley

[11] Patent Number: 5,272,281

[45] Date of Patent: Dec. 21, 1993

[54] ELECTRICAL OUTLET SAFETY COVER

[76] Inventor: Roger R. Bouley, Rte. 2, Box 2245, Litchfield, Me. 04350

[21] Appl. No.: 878,398

[22] Filed: May 4, 1992

[51] Int. Cl.[5] ..... H01R 13/447

[52] U.S. Cl. ..... 174/67; 439/147

[58] Field of Search ..... 174/67; 220/242; 439/135, 136, 147

[56] References Cited

U.S. PATENT DOCUMENTS

| | | | |
|---|---|---|---|
| 2,526,606 | 10/1950 | Gregg | 174/67 |
| 2,722,665 | 11/1955 | Sauder | 174/67 X |
| 2,761,112 | 8/1956 | Torcivia | 339/92 |
| 2,891,102 | 6/1959 | Grimes | 174/67 |
| 2,892,172 | 6/1959 | McGann, Jr. | 339/36 |
| 3,067,402 | 12/1962 | Thaw | 174/67 X |
| 4,605,817 | 8/1986 | Lopez | 174/67 |
| 4,851,612 | 7/1989 | Peckham | 174/67 |
| 4,993,963 | 2/1991 | Pedigo | 439/142 |

*Primary Examiner*—Leo P. Picard
*Assistant Examiner*—David Tone
*Attorney, Agent, or Firm*—Richard C. Litman

[57] ABSTRACT

An electrical outlet safety cover is made in three simple pieces: a four walled body, a cap having cord egress slots, and a small closure slidably insertable into and removable from the four walled body. The closure optionally provides top or bottom cord egress, the cap slots providing frontal and partial side egress. The cap entraps the body and small closure upon assembly, assembly being secured by a screw, threaded through the cap and engaging preexisting threads in the electrical outlet. The safety cover components are uncomplicated and inexpensive, yet rugged. The body is selectively positioned to provide different cord egress configurations. Electrical cords are not constrained to describe sharp bends within the cover, and may not be pulled laterally so as to bend the cord plug prongs.

4 Claims, 2 Drawing Sheets

ELECTRICAL OUTLET SAFETY COVER

FIELD OF THE INVENTION

The present invention relates to an electrical outlet safety cover.

DESCRIPTION OF THE PRIOR ART

The problems of access by children to electrical outlets and of propensity of children to pull electrical cords from outlets is longstanding. Attempts have been made over many years to design a safety cover which will place an effective barrier between children and outlets or their associated cord plugs. However, the unending progression of new proposed safety covers testifies to the failure of the prior art to successfully address the basic safety concerns and secondary aspects of practicality.

One of the main aspects is that of cost. A typical residential unit has many outlets, some of which are dedicated to long term if not permanent use, such as for lamps. Other outlets are reserved for intermittent or temporary duty, such as for appliances which will be removed and stored after each use. Therefore, a number of safety covers may be required to render the residence acceptably safe in regard to the present problem. Due to cost constraints, a residence dweller is likely to buy a sufficient number of safety covers to solve the problem throughout the residence, if he or she judges the cost to be within reason, or to abandon efforts in this respect entirely if the total cost is deemed onerous.

Additionally, many of the proposed safety covers have functional deficiencies. Those that provide only top, bottom or side cord egress are likely to require a sharp bend of the electric cord as it projects from the plug and turns upwardly or downwardly within the limited confines of the cover chamber. This problem may not arise with small gauge or thinly shielded cords, but many appliances have much thicker cords than, for example, lamps.

U.S. Pat. No. 2,761,112, issued to Armond J. Torcivia on Aug. 28, 1956, provides a two chambered cover. However, spacer sleeves used to secure the plug against removal must anticipate exactly the dimension of the plug. Also, Torcivia fails to provide for top, bottom or side cord egress. The internal construction provides a central wall eliminated in the present invention.

U.S. Pat. No. 2,891,102, issued to James E. Grimes on Jun. 16, 1959, provides a sleeve surrounding an attachment screw, an access screw and a back panel, these components adding to the cost, these components being eliminated in the present invention.

U.S. Pat. No. 2,892,172, issued on Jun. 23, 1959 to Leo E. McGann, Jr., exemplifies those safety covers requiring a sharp bend of the electrical cord within the cover. McGann, Jr. fails to provide frontal, top or bottom cord egress, and further provides complicated fastening securement.

U.S. Pat. No. 4,605,817, issued to Carlos A. Lopez on Aug. 12, 1986, also requires sharp bends, provides bottom cord egress only (top only if installed inverted), and requires two internal panels complicating construction of the safety cover.

U.S. Pat. No. 4,851,612, issued to Albert E. Peckham on Jul. 25, 1989, also requires sharp bends of a cord within the safety cover. Also, a baseplate and tab connectors increase cost.

U.S. Pat. No. 4,993,963, issued to William S. Pedigo on Feb. 19, 1991, provides a baseplate and hinged attachment therefor. Pedigo's elongated egress slots extending to the wall permit a cord to be pulled by a child such that the plug prongs could be bent.

None of the above inventions and patents, taken either singly or in combination, is seen to describe the instant invention as claimed.

SUMMARY OF THE INVENTION

The present invention provides a safety cover having a four walled body, a cap, and a screw for attachment. The body has a grooved recess in one wall. A small closure is removably inserted into this recess, thus optionally providing top or bottom cord egress. The cover has slots to provide frontal cord egress, and the rear face of the cover is stepped to cooperate with, and thus positively engage, the body. A beveled hole in the middle of the cover enables attachment of the cover to the screw hole conventionally used to attach an outlet cover to the outlet. When so attached, the cover securely entraps the body and the small closure between itself and the outlet.

The number of component parts of the safety cover is thus minimized. The body comprises four planar walls, complicated only by a small grooved recess. The closure fitting into this recess is rectangular and planar. Since it is entrapped when installed, neither precise fit nor fastening means are required.

The cover is essentially planar, modified to have two slots, a screw hole, and a step. The step results in a thick panel, this thickness providing strength to resist impacts and deflection resulting from screw tightening.

The major parts are thus simple and inexpensive to manufacture, yet rugged.

Two cover slots extend from about the cover center to a side (one to the right and the other to the left), thus providing direct frontal egress, and accommodating side egress in that the cord is permitted a gradual bending to the right or left prior to exiting the cover. This feature overcomes the necessity of a sharp bend of a cord within the safety cover. Since purely lateral egress is denied, it is most unlikely that an electrical cord can be pulled so as to bend the plug prongs.

The use of a screw nesting within a beveled hole assures that a tool, in this case, a common screwdriver, be used for assembly and disassembly.

Accordingly, it is a particular object of the present invention is to provide an electrical outlet safety cover which is of uncomplicated construction and inexpensive to manufacture.

A second object is to provide an electrical outlet safety cover which is rugged and durable.

Another object is to provide an electrical outlet safety cover which resists manual access and disassembly.

Still another object is to provide an electrical outlet safety cover which avoids sharp bends in an electrical cord within the cover.

A further object is to provide an electrical outlet safety cover which resists bending of plug prongs upon being a cord being pulled laterally.

A still further object is to provide an electrical outlet safety cover which selectively provides bottom and top cord egress in addition to frontal egress on both right and left sides.

With these and other objects in view which will more readily appear as the nature of the invention is better understood, the invention consists in the novel construction, combination and assembly of parts hereinafter more fully described, illustrated

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
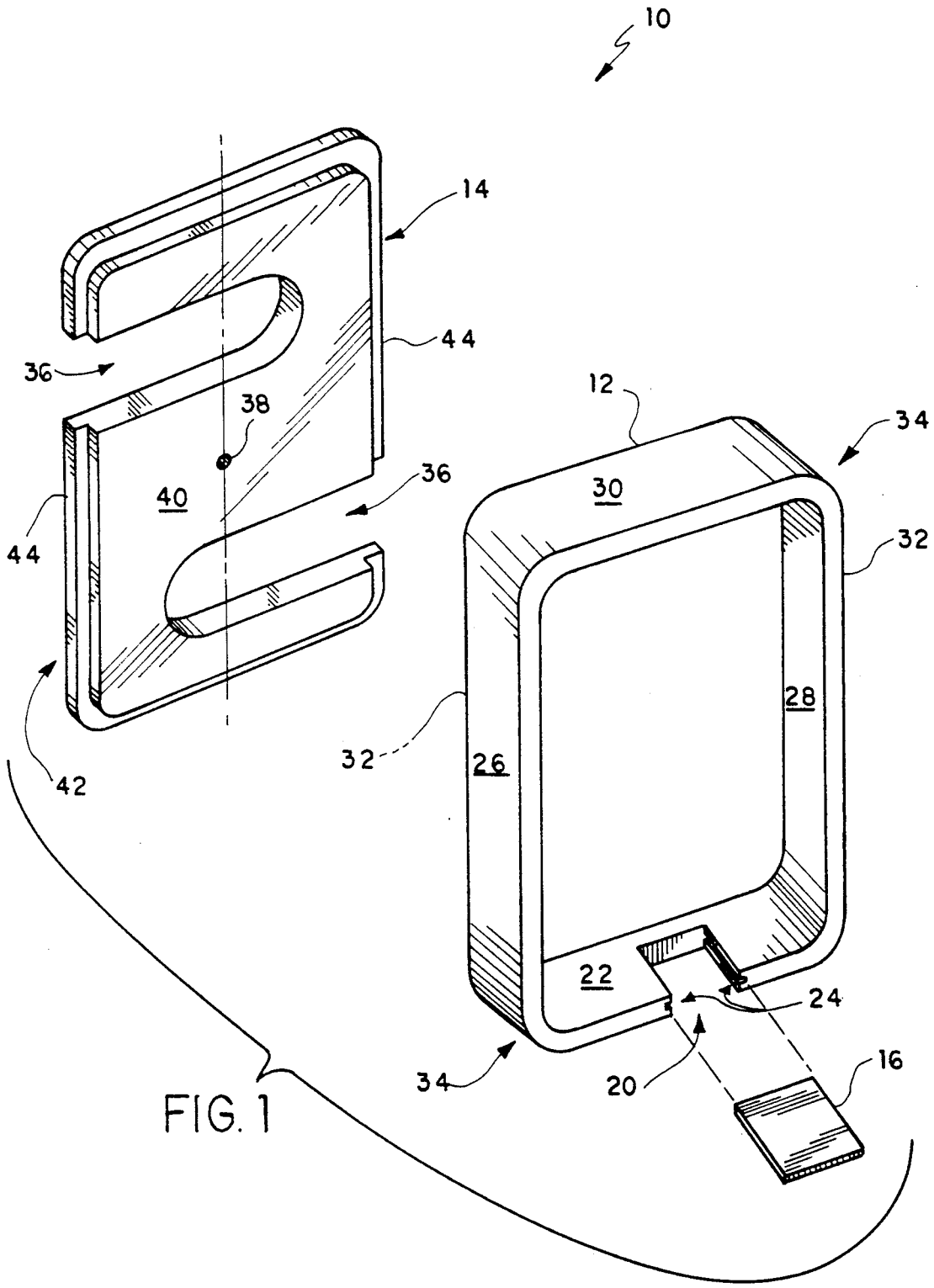
FIG. 1 is an exploded perspective rear view of the invention.
Figure 2:
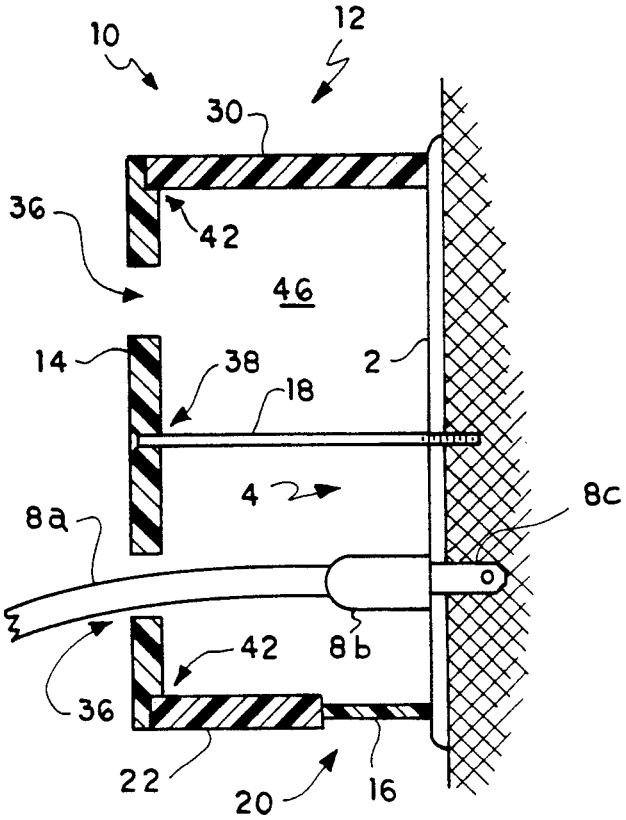
FIG. 2 is a side sectional environmental view of the invention.

The electrical outlet safety cover 10 of the present invention is seen in FIG. 1 to comprise a four walled body 12, a cap 14, and a small closure 16. A screw 18, shown only in FIG. 2, is used to assemble and install the safety cover 10, holding the body 12 and cap 14 in tight abutment and affixed to the cover plate 4 of a standard electrical outlet 2. The body 12 defines an aperture 20 in a bottom wall 22, the aperture 20 retaining the small closure 16. Grooves 24 formed in the aperture 20 slidably retain the small closure 16 therein. The body 12, formed as a single, unitary part (hereinafter referred to as unitary construction), also has right and left side walls 26, 28, and a top wall 30. The four walls 22, 26, 28, 30 have flat, even surfaces 32 on top and bottom sides. Thus, the body 12 presents a compatible contact surface to the outlet cover plate 4 upon which it bears when installed.

Figure 3:
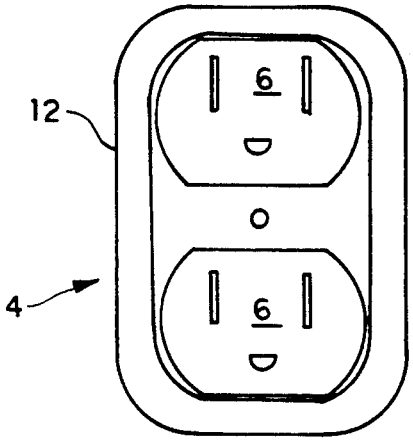
FIG. 3 is a front elevational view of the body, superimposed over a standard duplex electrical outlet.

As seen in FIG. 3, the body 12 is configured to closely correspond to the configuration of and surround the two receptacles 6 of a standard electrical duplex outlet 4. The four walls 22, 26, 28, 30 of the body 12, therefore, have rounded joints 34. For any given wall thickness, the overall dimensions of the body 12 are thus minimized, there being attendant reductions in expense of manufacture and packaging.

When the safety cover 10 is installed, as shown in FIG. 2, the body 12 is entrapped between the cap 14 and the cover plate 2. The small closure 16, which is optionally removed to provide an additional cord egress orifice, is entrapped between the body 12 and the cover plate 2.

The body 12 is essentially symmetrical, except for the closure aperture 20, and therefore may be mounted in several positions so as to locate the closure aperture 20 advantageously. As shown in FIG. 2, the small closure 16 is located in a downward orientation and abutting the outlet cover plate 2. The body 12 may be inverted, if desired, to locate the small closure 16 in an upward orientation. Further, the body 12 may be mounted with either the top or bottom wall surfaces 32 facing the cap 14. Again, the body 12 may be manipulated so that the aperture 20 may be oriented upwardly or downwardly.

Again referring to FIG. 1, the cap 14 is seen to be essentially planar and also of unitary construction, defining therein two cord egress slots 36, a screw hole 38, and, on a rear face 40, a step 42. The slots 36 originate either to the right or to the left hand side of the screw hole 38, which screw hole 38 defines a longitudinal center line C of the cap 14. Each slot 36 extends laterally past the center line C to the cap peripheral side 44 opposite the origination point of the respective slot 36. Thus, each slot 36 accommodates frontal and also either right or left handed cord egress.

Figure 4A:
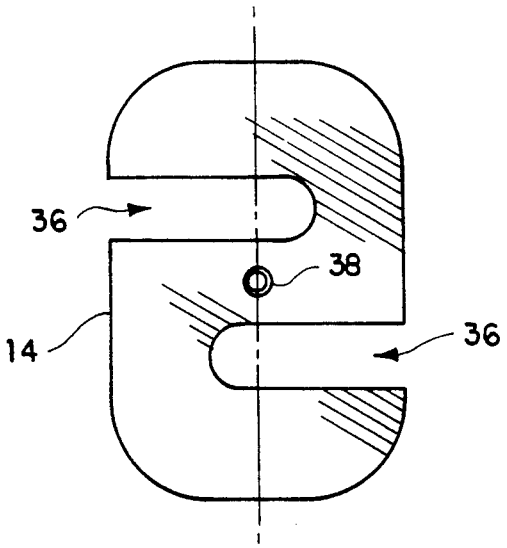
FIGS. 4A and 4B are front elevational views of alternative embodiment caps.
Figure 4B:
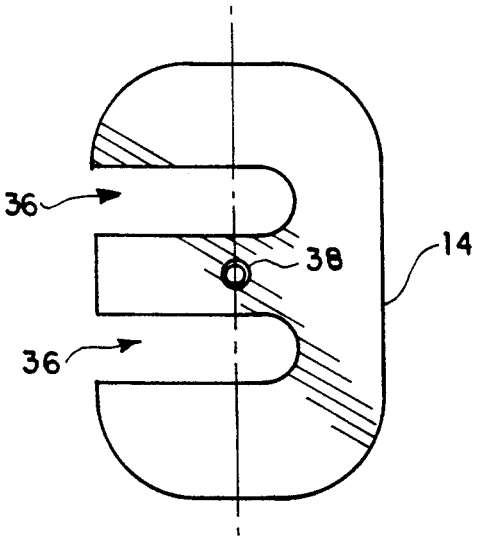

Other cap configurations are possible, as seen in FIGS. 4A and 4B. Bearing in mind that the cap 14 of FIG. 1 is shown from the rear, it will be appreciated that the upper slot 36 opens to the right side. In FIG. 4A, a cap 14 has an upper slot 36 opening to the left. FIG. 4B illustrates a cap 14 having both slots 36 opening to one side. The same body 12 is usable with any of these caps 14, so that manufacturing costs are minimized for different cord egress configurations.

The step 42 formed in the cap 14 enables the cap 14 to seat securely within a chamber 46 defined by the body 12. The cap 14 is constrained by interference fit not to slide laterally and thus expose the chamber 46, nor to project further into this chamber 46.

Turning again to FIG. 2, an electrical cord 8A is shown plugged into a receptacle (not shown) and exiting the safety cover 10 frontally. The cord 8A has direct access to its egress slot 36, and consequently need not bend sharply. It is further possible to bend the cord 8A gradually to the right side, if using the upper slot 36, opposite hand operation being similar when selecting the lower slot 36.

If bottom egress is desired, the small closure 16 is removed. If the ensuing cord bend is deemed too sharp for the cord 8A, then the body 12 may be manipulated to locate the small closure 16 against the cap 14. Again, the small closure 16 may be oriented upwardly or downwardly, so that even with a single cap configuration, many egress paths are available.

If a child should grasp and pull an electrical cord 8A from a side, the cord 8A will contact a body side wall 26 or 28, and will not subject the plug 8B to a lateral pull. The plug prongs 8C are therefore protected against being spread or distorted.

The safety cover 10 of the present invention is thus uncomplicated and inexpensive, yet versatile, and precludes injurious contact with an associated electrical cord 8A.

Preferably, the components of the invention (except for screw 18) are made of any suitable, well known insulative material, e.g., plastic.

It is to be understood that the present invention is not limited to the embodiments described above, but encompasses any and all embodiments within the scope of the following claims.

I claim:

1. An electrical outlet safety cover comprising:

a body comprising a right side wall, a left side wall, a top wall and a bottom wall, said walls having flat and even top and bottom surfaces, whereby said body is selectively installed with said top and bottom wall surfaces mounted against an electrical outlet cover plate, said body being of unitary construction and also being symmetrical such that said top and bottom walls are interchangeable upon said body being inverted, and a cap comprising a planar panel, means defining a plurality of slots therethrough, extending to a periphery of said cap, a centrally located hole, and a step formed on a rear face of said cap, said cap being of unitary construction and separable from said body, whereby said cap is seated within said body, in immobile fashion, and further is constrained against projection into said body, and whereby said safety cover is assembled and securely fixed in place over an electrical outlet by insertion of a screw through said cover central hole and connection to cooperating threads in the electrical outlet, and an electrical cord is reeved through said slots selectively at a top, a bottom, a front, a front right and a front left side of said safety cover, the cord not being constrained to make a sharp bend within said safety cover.

2. The electrical outlet safety cover of claim 1, further comprising a removable closure disposed within said top wall such that said closure is partially surrounded by said top wall and is immovably entrapped within said top wall upon installation of said safety cover over an electrical outlet, said closure being slidably removable when said safety cover is removed from the electrical outlet.

3. The electrical outlet safety cover of claim 1, each one of said plurality of slots originating just past a longitudinal center line of said cap and extending to said periphery, whereby an electrical cord exiting said safety cover partially describes a bend within said safety cover, the bend in its entirety being along sufficient length of the cord so as not to cause damage to the cord from fatigue, stretching or fraying.

4. An electrical outlet safety cover comprising:

a body comprising a right side wall, a left side wall, a top wall and a bottom wall, there being rounded joints joining said walls, said walls having flat and even top and bottom surfaces, whereby said body is selectively installed with said top and bottom wall surfaces mounted against an electrical outlet cover plate, said body being of unitary construction and also being symmetrical such that said top and bottom walls are interchangeable upon said body being inverted, said body defining therein a center area, said central area corresponding to and closely surrounding the receptacles of a standard duplex electrical outlet, dimensions of said body thus being minimized, and a cap comprising a planar panel, means defining a plurality of slots therethrough extending to a periphery of said cap, a centrally located screw hole, and a step located on a rear face of said cap, said cap being of unitary construction and being separable from said body, whereby said cap is seated within said body, in laterally immobile fashion and further is constrained against projection into said body, whereby said safety cover is assembled and securely fixed in place over an electrical outlet by insertion of a screw through said cap central hole and connection thereof to cooperating threads in the electrical outlet, and an electrical cord is reeved through said slots selectively at a top, a bottom, a front, a front right and a front left side of said safety cover, the cord not being constrained to make a sharp bend within said safety cover.

* * * * *